US011261067B1

(12) United States Patent
Ridl

(10) Patent No.: US 11,261,067 B1
(45) Date of Patent: Mar. 1, 2022

(54) WASTE PUMP REMOVAL APPARATUS

(71) Applicant: Bradley Donald Ridl, Renville, MN (US)

(72) Inventor: Bradley Donald Ridl, Renville, MN (US)

( * ) Notice: Subject to any disclaimer, the term of this patent is extended or adjusted under 35 U.S.C. 154(b) by 294 days.

(21) Appl. No.: 15/902,208

(22) Filed: Feb. 22, 2018

(51) Int. Cl.

| | |
|---|---|
| ***B66F 9/065*** | (2006.01) |
| ***B66F 9/22*** | (2006.01) |
| ***B66F 9/18*** | (2006.01) |
| *F15B 21/08* | (2006.01) |

(52) U.S. Cl.
CPC ..... *B66F 9/065* (2013.01); *B66F 9/18* (2013.01); *B66F 9/22* (2013.01); *F15B 21/08* (2013.01)

(58) Field of Classification Search
CPC .... B66F 9/16; B66F 9/082; B66F 7/28; B66F 7/065; B66B 9/16
See application file for complete search history.

(56) References Cited

U.S. PATENT DOCUMENTS 3,812,979 A * 5/1974 Leihgeber ..... B66C 13/18 212/261
4,030,626 A * 6/1977 Durham ..... E02F 3/404 414/704
4,212,577 A * 7/1980 Swanson ..... B66C 1/427 294/201
4,368,873 A * 1/1983 Perry ..... E21B 19/086 173/27
4,621,972 A * 11/1986 Grotte ..... B60P 1/64 280/414.5
5,516,174 A * 5/1996 Squyres ..... A01G 23/04 294/206
6,718,661 B1 * 4/2004 Miller ..... E02F 3/962 37/395
2005/0161654 A1 * 7/2005 Ancell ..... B66F 9/065 254/334
2007/0180742 A1 * 8/2007 Kallevig ..... E02F 3/3609 37/403
2010/0239405 A1 * 9/2010 Tesinsky ..... B66F 9/12 414/686

* cited by examiner

*Primary Examiner* — Gerald McClain

(57) ABSTRACT

A waste pump removal apparatus for removing pumps from reception areas for maintenance. The waste pump removal apparatus includes a frame having front and back ends, a top and a bottom; a loader attachment coupled to the back end of the frame and adapted to mount to a loader; a pump attachment pivotably connected to the front end of the frame and adapted to be coupled to a waste pump; and an actuator mounted to the frame and in communication with the pump attachment for pivoting the pump attachment relative to the frame to remove the waste pump from a reception area.

7 Claims, 3 Drawing Sheets

WASTE PUMP REMOVAL APPARATUS

BACKGROUND OF THE INVENTION

Field of the Invention

The present invention relates to removal devices and more particularly pertains to a new waste pump removal apparatus for removing pumps from reception areas for maintenance.

Description of the Prior Art

The use of removal devices is known in the prior art. More specifically, removal devices heretofore devised and utilized are known to consist basically of familiar, expected and obvious structural configurations, notwithstanding the myriad of designs encompassed by the crowded prior art which have been developed for the fulfillment of countless objectives and requirements.

The prior art includes a discharge head having a pair of axially spaced end walls defining in part an annular chamber therebetween. The tank includes a housing in communication with a liquid outlet conduit. By seating the discharge head in the tank housing, an annular pump discharge chamber is defined with the housing and between the end walls of the pump. Another prior art describes a pivot frame located on a transportable base frame. A take up reel for the flexible tubing is also supported on the pivot frame by a pair of pivoting support arms. Also, another prior art includes an apparatus for raising and lowering a submersible pump in a well. A cylindrical drum for reeling flexible water pipe is mounted for rotation at one side of the well. Further, another prior art describes an apparatus for pulling a well pipe and downhole pump from a well and is constructed of relatively lightweight materials to enable the apparatus to be easily moved to a well site by the provision of a frame structure supported by relatively large wheels and a handle structure which enables the apparatus to be pushed, pulled or lifted for movement to an accurate orientation in relation to the well site and well casing with the apparatus providing a solid connection with the well casing for safe and efficient operation. Yet, another prior art describes a portable pump removal equipment is provided which includes a collar to be secured to the upper end of a well casing, a pair of arms extending outwardly and upwardly from the collar with a wheel rotatably mounted on the outer ends of the pair of arms. While these devices fulfill their respective, particular objectives and requirements, the aforementioned patents do not disclose a new waste pump removal apparatus.

SUMMARY OF THE INVENTION

The general purpose of the present invention, which will be described subsequently in greater detail, is to provide a new waste pump removal apparatus which has many of the advantages of the removal devices mentioned heretofore and many novel features that result in a new waste pump removal apparatus which is not anticipated, rendered obvious, suggested, or even implied by any of the prior art removal devices, either alone or in any combination thereof. The present invention includes a frame having front and back ends, a top and a bottom; a loader attachment coupled to the back end of the frame and adapted to mount to a loader; a pump attachment 23 pivotably connected to the front end of the frame and adapted to be coupled to a waste pump; and an actuator mounted to the frame and in communication with the pump attachment 23 for pivoting the pump attachment 23 relative to the frame to remove the waste pump from a reception area. None of the prior art includes the combination of the elements of the present invention.

There has thus been outlined, rather broadly, the more important features of the waste pump removal apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new waste pump removal apparatus which has many of the advantages of the removal devices mentioned heretofore and many novel features that result in a new waste pump removal apparatus which is not anticipated, rendered obvious, suggested, or even implied by any of the prior art removal devices, either alone or in any combination thereof.

Still another object of the present invention is to provide a new waste pump removal apparatus for removing pumps from reception areas for maintenance.

Still yet another object of the present invention is to provide a new waste pump removal apparatus that quickly and efficiently removes waste pumps from reception area which otherwise can very labor intensive.

Even still another object of the present invention is to provide a new waste pump removal apparatus that effectively extends to and reaches the waste pump in the reception area without using chains that would drag the pump through the muck.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
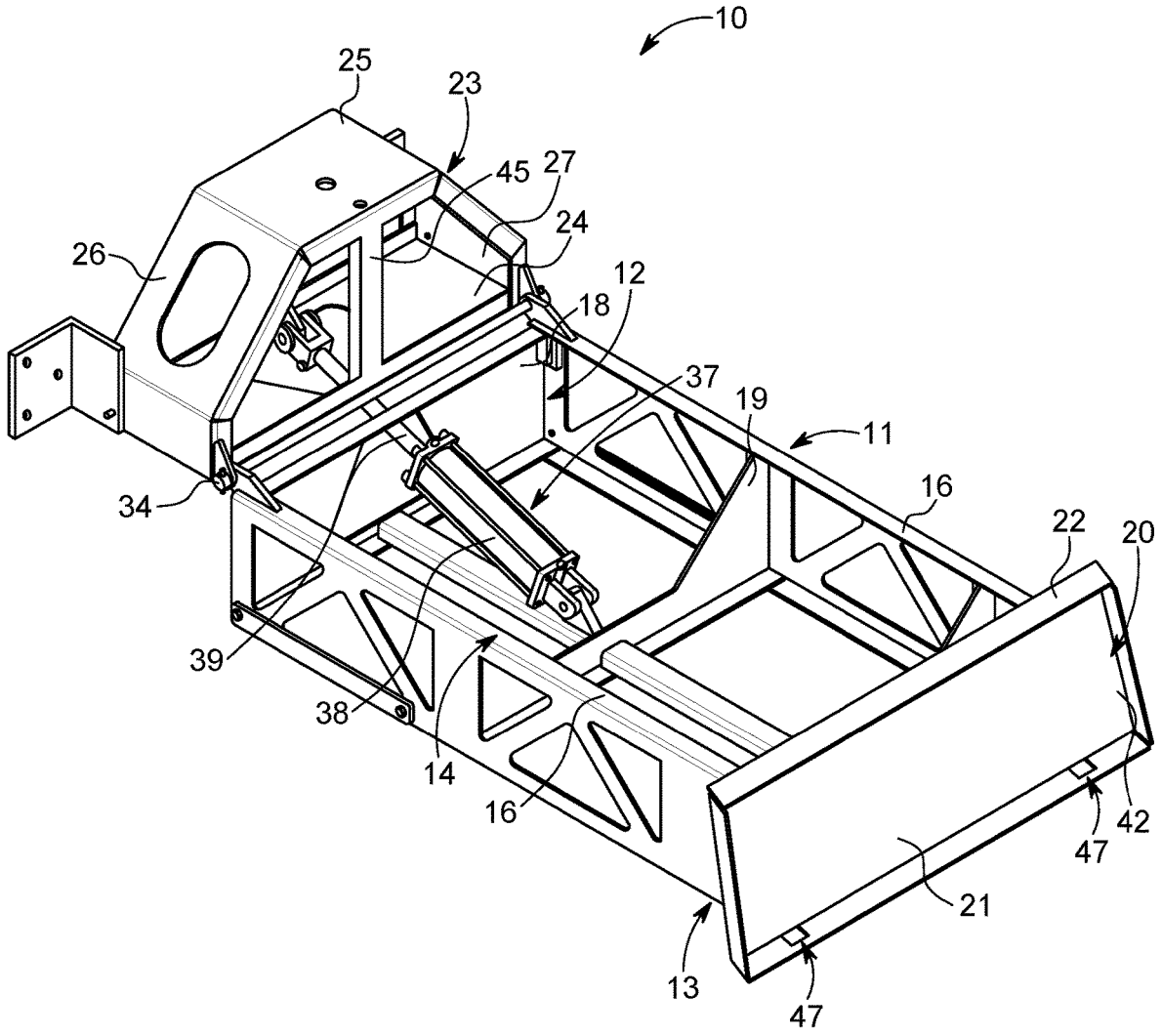
FIG. 1 is a perspective view of a new waste pump removal apparatus according to the present invention.
Figure 2:
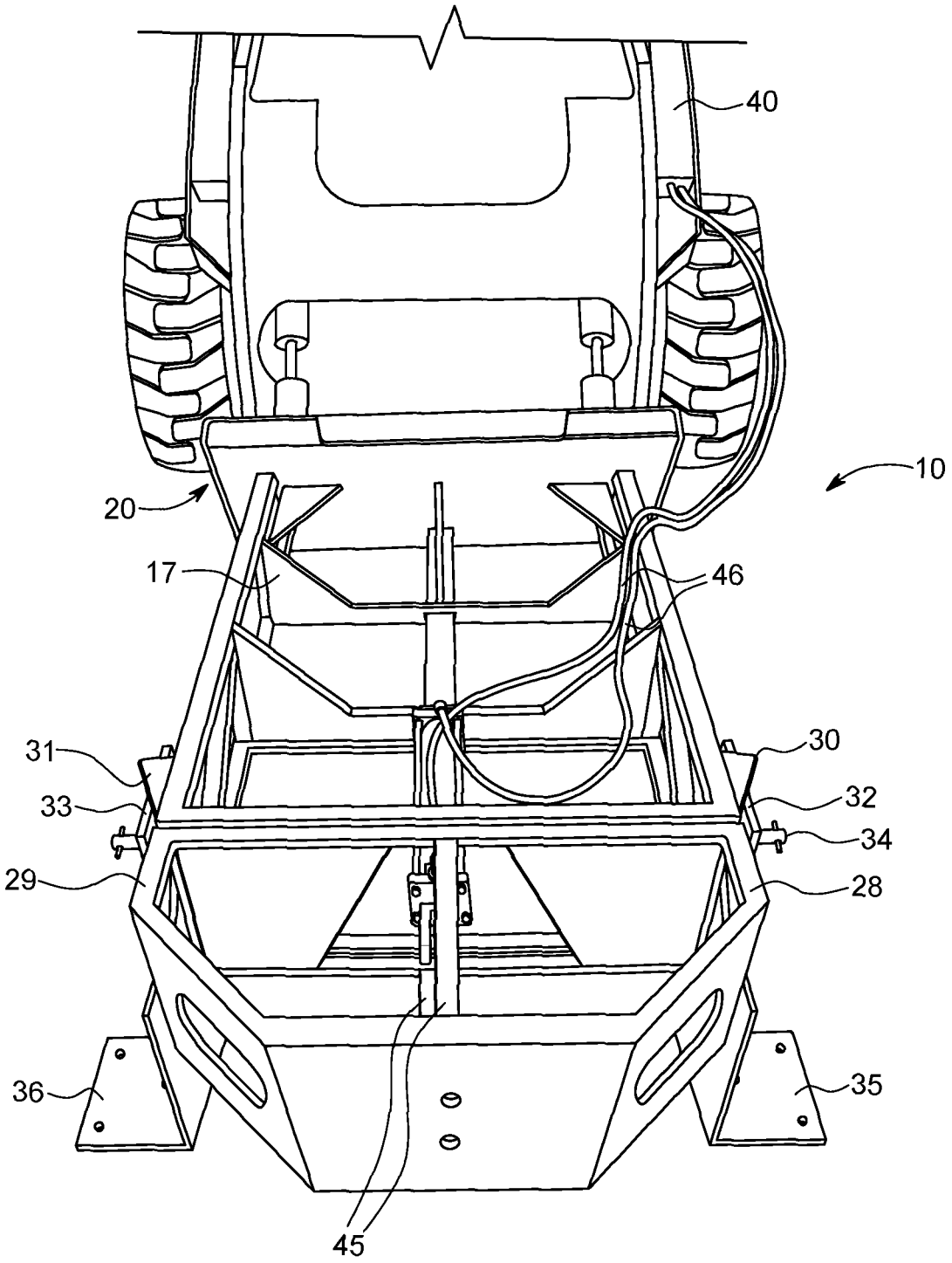
FIG. 2 is a perspective view of the present invention attached to a waste pump.
Figure 3:
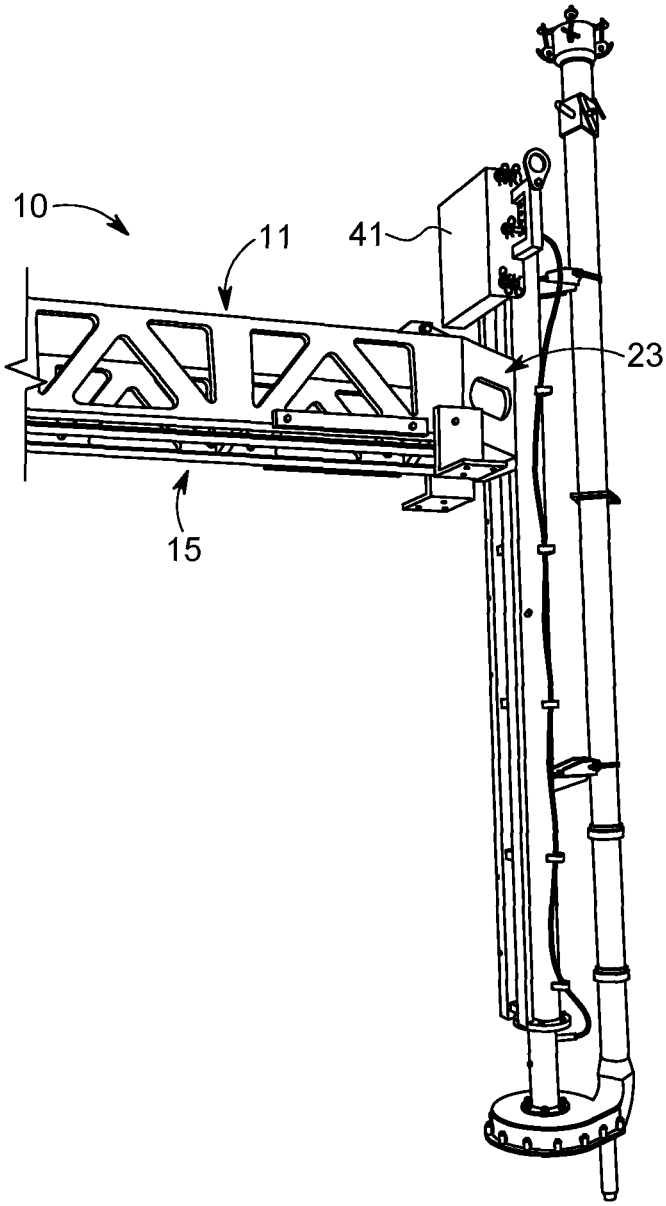
FIG. 3 is a perspective view of the present invention mounted to a skid loader.

With reference now to the drawings, and in particular to FIGS. 1 through 3 thereof, a new waste pump removal apparatus embodying the principles and concepts of the present invention and generally designated by the reference numeral 10 will be described.

As best illustrated in FIGS. 1 through 3, the waste pump removal apparatus 10 generally comprises a frame 11 having front and back ends 12,13, a top 14 and a bottom 15; a loader attachment 20 conventionally coupled to the back end 13 of the frame 11 and adapted to mount to a loader 40; a pump attachment 23 pivotably connected to the front end 12 of the frame 11 and adapted to be coupled to a waste pump 41; and an actuator 37 conventionally mounted to the frame 11 and in communication with the pump attachment 23 for pivoting the pump attachment 23 relative to the frame 11 to remove the waste pump 41 from a reception area.

The frame 11 includes elongated support members 16 spaced apart and disposed parallel to one another and also includes cross members 17-19 conventionally interconnecting the elongated support members 16. The cross members 17-19 include a back cross member 17 disposed proximate to the back end of the frame 11 and also includes a front cross member 18 disposed at the front end 12 the frame 11 and further includes an intermediate cross member 19 disposed intermediate of the frame 11.

The loader attachment 20 includes a planar member 21 having a perimeter 42 with a flange 22 integrally disposed along the perimeter 42 of the planar member 21 to facilitate mounting the frame 11 to the loader 40. The back end 13 of the frame 11 rests in a plane and the planar member 21 is angled relative to the back end 13 of the frame 11. The planar member 21 is slanted outwardly from the top 14 to the bottom 15 of and away from the frame 11. The loader attachment 20 also includes holes 47 disposed through the flange 22 for mounting the loader attachment 20 to the loader 40.

The pump attachment 23 includes a back wall 24 which is pivotably connected to the front end 12 of the frame 11, and also includes side walls 26,27 and a front wall 25 which is spaced from the back wall 24 of the pump attachment 23 and is adapted to be removably secured to the waste pump 41. The side walls 26,27 of the pump attachment 23 have top edges 28,29.

The waste pump removal apparatus 10 includes first brackets 30,31 conventionally mounted upon the top 14 of the frame 11 at the front end 12 of the frame 11, and also includes second brackets 32,33 conventionally mounted upon the top edges 28,29 of the side walls 26,27 of the pump attachment 23, and further includes a rod 34 conventionally disposed through and conventionally interconnecting the first and second brackets 30-33. The second brackets 32,33 are pivotable about the rod 34. The pump attachment 23 is pivotable upwardly relative to the frame 11 and adapted to remove the waste pump 41 from the reception area. The pump attachment 23 also includes guide members 35,36 conventionally fastened to the side walls 26,27 and adapted to be conventionally fastened to the waste pump 41. The guide members 35,36 are L-brackets. The pump attachment 23 further includes braces 45 conventionally interconnecting the front and back walls 24,25.

The actuator 37 is a hydraulic cylinder. The hydraulic cylinder 37 includes a cylinder barrel 38 conventionally coupled to the frame 11, and also includes a piston rod 39 in conventional communication with the cylinder barrel 38 and conventionally coupled to the pump attachment 23, and further includes hoses 46 conventionally connected to the cylinder barrel 38 and adapted to carry hydraulic fluid from a power source to energize the hydraulic cylinder 37 to pivot the pump attachment 23 relative to the frame 11.

In use, the pump attachment 23 is conventionally secured to the waste pump 41. The loader attachment 20 is conventionally mounted to the loader 40. The actuator 37 is energized with hydraulic fluid to pivot the pump attachment 23 upwardly and relative to the frame 11 to remove the waste pump 41 from a reception area.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the waste pump removal apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A waste pump removal apparatus comprising:

a frame having front and back ends, a top and a bottom, each of the top and bottom of the frame being planar, the top and bottom being parallel wherein the frame is rectangular box-shaped, wherein the frame includes elongated support members spaced apart and disposed parallel to one another and also includes cross members interconnecting the elongated support members, the cross members being perpendicular to the elongated support members, wherein the cross members include an end cross member disposed proximate to the back end of the frame and also includes a front end cross member disposed at the front end of the frame and further includes an intermediate cross member disposed intermediate of the frame;

a loader attachment coupled to the back end of the frame and adapted to mount to a loader, the loader attachment having a planar member and a flange disposed along a perimeter of the planar member;

a pump attachment pivotably connected to the front end of the frame and adapted to be coupled to a waste pump, wherein the pump attachment includes a back wall which is pivotably connected to the front end of the frame, and also includes side walls and a front wall which is spaced from the back wall of the pump attachment and is adapted to be removably secured to the waste pump, the pump attachment having a planar top defined by respective top edges of the back wall, side walls, and front wall of the pump attachment, the planar top of the pump attachment being coplanar with the top of the frame when the pump attachment is unpivoted relative to the frame; and an actuator mounted to the frame and in communication with the pump attachment for pivoting the pump attachment relative to the frame and adapted to remove the waste pump from a reception area, wherein the actuator is a hydraulic cylinder, wherein the hydraulic cylinder includes a cylinder barrel having a base end coupled to the intermediate cross member of the frame, and also includes a piston rod in communication with the cylinder barrel, the piston rod having a distal end relative to the cylinder barrel, the distal end of the piston rod being pivotally coupled to the pump attachment, and further includes hoses connected to the cylinder barrel and adapted to carry hydraulic fluid from a power source to energize the hydraulic cylinder to pivot the pump attachment relative to the frame.

2. The waste pump removal apparatus as described in claim 1, wherein the back end of the frame rests in a plane and the planar member is angled relative to the back end of the frame.

3. The waste pump removal apparatus as described in claim 2, wherein the planar member is slanted outwardly from the top to the bottom of and away from the frame; wherein the loader attachment also includes holes disposed through the flange for mounting the loader attachment to the loader.

4. The waste pump removal apparatus as described in claim 1 further includes first brackets mounted upon the top of the frame at the front end of the frame, and also includes second brackets mounted upon the top edges of the side walls of the pump attachment, and further includes a rod disposed through and interconnecting the first and second brackets.

5. The waste pump removal apparatus as described in claim 4, wherein the second brackets are pivotable about the rod; wherein the pump attachment is pivotable upwardly relative to the frame to remove the waste pump from the reception area.

6. The waste pump removal apparatus as described in claim 1, wherein the pump attachment also includes guide members fastened to the side walls and adapted to be fastened to the waste pump.

7. The waste pump removal apparatus as described in claim 1, wherein the pump attachment further includes braces interconnecting the front and back walls.

* * * * *